US006724906B2

(12) United States Patent
Naksen et al.

(10) Patent No.: US 6,724,906 B2
(45) Date of Patent: Apr. 20, 2004

(54) ADJUSTABLE HEADPHONE

(76) Inventors: Alex Naksen, 142-15 26th Ave., Apt. 2H, Flushing, NY (US) 11354; Dennis Naksen, 142-15 26th Ave., Apt. 2H, Flushing, NY (US) 11354

( * ) Notice: Subject to any disclaimer, the term of this patent is extended or adjusted under 35 U.S.C. 154(b) by 112 days.

(21) Appl. No.: 10/140,348

(22) Filed: May 7, 2002

(65) Prior Publication Data

US 2003/0210801 A1 Nov. 13, 2003

(51) Int. Cl.[7] ..... H04R 25/00

(52) U.S. Cl. ..... 381/379; 381/370; 381/374; 381/377

(58) Field of Search ..... 381/77, 370, 371, 381/374, 376, 377, 379; 379/430; 181/129

(56) References Cited

U.S. PATENT DOCUMENTS

| | | | |
|---|---|---|---|
| 1,714,377 | A | 5/1929 | Kiernan |
| 2,420,245 | A | 5/1947 | Hurst |
| 3,919,501 | A | 11/1975 | Cech et al. |
| 4,189,788 | A | 2/1980 | Schenke et al. |
| 4,455,457 | A | 6/1984 | Akira |
| 4,499,593 | A | 2/1985 | Antle |
| 4,965,836 | A | 10/1990 | Andre et al. |
| 5,117,465 | A | 5/1992 | MacDonald |
| 5,406,037 | A | 4/1995 | Nageno et al. |
| 5,574,795 | A | 11/1996 | Seki |

*Primary Examiner*—Suhan Ni

(57) ABSTRACT

An adjustable headphone comprising a pair of self-adjusting earpieces interconnected by a headpiece that includes a stiff resilient headband assembly and a soft flexible headstrap resting against a wearer's head. The headstrap is anchored at least at one end to a corresponding sliding block movably joined with the headband assembly having a bifurcated gear rack on its inner surface. The sliding block is equipped with at least one spring-loaded detent coming in contact with the gear rack. The headband assembly forms with at least one earpiece a hollow ball-and-socket joint where the spherical driver cup works as a ball part of the joint, and it mates to the arm's inner spherical surface which is a socket part of the joint. This joint provides the earpiece substantial angular motion in all directions thus enabling it to adjust to any ear shape.

1 Claim, 7 Drawing Sheets

ADJUSTABLE HEADPHONE

CROSS-REFERENCE TO RELATED APPLICATIONS

"Not Applicable"

STATEMENT REGARDING FEDERALLY SPONSORED RESEARCH OR DEVELOPMENT

"Not Applicable"

REFERENCE TO A SEQUENCE LISTING, A TABLE, OR A COMPUTER PROGRAM LISTING COMPACT DISC APPENDIX

"Not Applicable"

BACKGROUND OF THE INVENTION

This invention relates in general to the design of headphones and, in particular, to headphones that have an inner flexible headband or a headstrap coming in contact with the user's head, and this headstrap may alter in length or size to ensure proper fit of an earpiece to the head. The headstrap is anchored at each end to an outer headband, interconnecting a pair of earpieces, and also providing a resilient inner force to hold the headphone in place. Secondly, this invention relates to the headphones having particular cup structure designed to fit the earpiece over the user's ear.

There are numerous headphones having the mentioned above structure varying in acoustical parameters, design specifics and so forth. Nevertheless, it is rather hard to find an inexpensive headphone which can be worn comfortably for a relatively long period of time in one session. This is especially true for young computer users who spend long hours in front of the computer screen playing games or surfing the Net for their favorite musical and video files. A headphone's ability to adjust completely and comfortably to a particular user is becoming as important as its acoustical parameters.

The problem of a headphone adjustment mainly consists of two components that can be classified by a particular function which has to be performed to have comfortable and sustained accommodation to the user. Firstly, a headphone's headband has to provide proper positioning of the earpiece in a vertical axial direction in order to accommodate the distance from the scalp to the ear which varies from user to user. It constitutes the axial adjustment problem. Secondly, the headphone's driver unit has to fit closely and comfortably to the outer part of the ear, the pinna, in order to create an ergonomically and acoustically necessary coupling space between them. This is a problem of adjustment to the pinna.

AXIAL ADJUSTMENT PROBLEM

There are two commonly used ways to to adjust a headphone in a vertical axial direction. The first is when an earpiece and a headband are movably connected, providing telescopically adjustable positioning to the earpiece. This is telescopic detent-based adjustment. The second is when the vertical adjustment is based on changing the geometry of a headstrap having some elastic members, without manually moving parts, thus providing a headphone with axial self-adjustment.

Telescopic Detent-Based Adjustment

In the first case, the telescopically connected earpiece is moved manually, and its holding in place is made possible by means of a special positioning member, a detent, releaseably engaging one of corresponding depressions or openings. The detent can be part of either a headband or an earpiece. Consequently, the earpiece assembly, as well as the headband, can include a plurality of depressions or openings being designed to accommodate the detent. There are several headphone designs based on this concept. The design with the plurality of openings and the wedge shaped detent is described in U.S. Pat. No. 4,189,788 to Schenke et al. (1980). The elastic projecting member at the headband's end is shown in U.S. Pat. No. 4,445,457 to Jingu Akira (1984). The headphone with progressively shallow depressions is disclosed in U.S. Pat. No. 5,117,465 to James T. MacDonald (1992).

The main disadvantage of this design concept is a certain contradiction inherent to it. The detent's holding power has to be substantial enough to secure the earpiece in place, and, at the same time, it becomes a source of inconvenience when one needs to move the earpiece in order to adjust it. The greater is the holding power of the detent—the more resistance it creates to adjust the earpiece. Moreover, a headphone detent's ability to function greatly depends on its material properties. The wide application of plastic with significantly less resilience and durability, than that of stainless steel, results in lesser holding power, which can be applied by the detent. It means that during use the earpiece support becomes liable to get loose or shift from the headband, causing dislocation of the earpiece from the proper position on the pinna.

Therefore an optimal axial adjustment mechanism that balances the ease of use with precise and sustainable accommodation to the wearer is rather difficult to achieve in a framework of the telescopic detent-based adjustment. Alternatively, a concept of axial self-adjustment has been employed to satisfy users needs for a quick and comfortable fit of the headphones.

Axial Self-Adjustment

The conventional way of vertical axial self-adjustment is based on the use of some structural resilience in various embodiments. The most common way is when a headstrap is connected to earpieces by means of an elastic suspension in the form of elastic members, such as helical springs, flat coil springs or bands. Initially this idea was embodied in a headphone design described in U.S. Pat. No. 3,919,501 to Cech et al. (1975). A rather sophisticated suspension concept is realized in the form of a wind-in mechanism which is disclosed in U.S. Pat. No. 5,406,037 to Nageno et al (1995). The idea of having a suspender member consisting of some expendable and non-expendable sections is realized in U.S. Pat. No. 5,574,795 to Seki (1996).

Despite the differences the basic self-adjustment concept requires that the elastic member suspends the earpieces in such a manner that they are retracted upwardly by the resilient force of this elastic member and must be extended downward manually from their retracted position during the application to a wearer's ears. During the downward movement elastic member is stretched and it produces a return force corresponding to the respective distance between the top of the user's head and the ear opening. This return force pulls earpieces upward, and in order to hold them in place it must be counteracted by the friction between the earpiece pad and the ear. The friction is directly proportional to the opposite horizontal forces pressing the earpieces against the user's ears. These forces are produced by the headband's resilient resistance to its being pulled apart as a result of adjustment to the head.

Apparently, in order to have a headphone comfortably fitting the user, all these forces affecting the wearer's head must be balanced. The more elastic member is stretched—the greater friction has to be applied to balance the return forces created by this action. Thus, the disadvantage of this concept is that the system inevitably creates excessive pressure on the scull and ears, and especially, if the wearer's head is bigger than the average one. Additionally, the typical problem of these adjustment mechanisms based on the material's elasticity is that after some period of usage some of them are beginning to slacken off, causing dislocation of the earpiece from the proper position on the pinna. The common way to avoid this is to increase the stiffness of the elastic member, consequently making the initial pressure even greater. Considering the nature of these balanced forces and the great variety of human forms and shapes the necessary equilibrium can be reached either for a limited number of people or for a limited time only.

Therefore this type of adjustment provides quick but eventually uncomfortable and unsustainable accommodation to the user, and thus it is best suited for a situation when a headphone has to be shared by a group of users. For instance, headphones in musical records stores are generally used by different people for a relatively short period of time. To the contrary, in regards to personal usage, the most typical situation is when a headphone is used for a relatively long period of time by one person, and that requires to have comfortable, precise and sustainable accommodation to the user.

ADJUSTMENT TO THE PINNA PROBLEM

The apparent diversity of ear shapes creates a problem of an earpiece's proper adjustment in order to provide close and comfortable fit to the pinna. The earpiece's close fit allows to form an acoustically desirable coupling space between a driver and the auditory canal of the user's ear.

The common way is to combine adjustment in a horizontal plane by using a C-shape arm holding the earpiece, and adjustment in a vertical plane by having a hinge connecting the headband and the bracket. This structure is designed on the assumption that a sculpturally complex three-dimensional shape, like the human ear, can be significantly simplified without losing its essential properties. It can be accepted as a basic design model if a headphone is used for a relatively short working session, but for prolonged usage it becomes a source of the user's discomfort.

The more advanced approach allows to perceive the human shapes as complex as they really are. In regards to the ear it means allowing for the earpiece to have some relative angular motion in different directions in order to accommodate the driver unit in relation to the user's pinna. There are some headphones where a driver unit is attached to a headband by a means of a ball-and-socket joint providing certain angular motion.

For instance, this way of attachment allowing biaxial motion of a face plate carrying a transducer is described in U.S. Pat. No. 4,965,836 to Andre et al. (1990). A small ball integrally formed on the hub of the spider element belonging to the face plate, is fitted into a socket, provided by a socket plate, which is permanently attached to the inside surface of the cover. The certain disadvantage of this joint is its bulky and complex supporting structure. Accordingly, it necessitates to have additional room to accommodate the joint, and this significantly increases the headphone's overall size. Secondly, after some period of usage and consequent mechanical wear, this type of joint can unexpectedly fall apart, because its design only relies on material properties and the joint is not secured in any other way.

An alternative way to accommodate a conventional ball-and-socket joint is employed in the HD 475 Expression Line headphone manufactured by Sennheiser Electronic GmbH & Co. KG, Am Labor, Germany. This headphone sports a joint placed in a special recessed area of the driver housing 12. Its way of adjustment is shown in FIGS. 1 through 2B. The small spherical knob 13 belongs to the driver unit 12, and the mating socket 11, consisting of two longitudinally placed ribs, is part of the headband 10. The unwanted ramification of the joint's recessed positioning is that it negatively affects the acoustical quality of the driver housing 12. When a speaker driver is activated, it vibrates and pushes air forward, producing sound. At the same time sound waves are transmitted backward bouncing off the recessed area and other housing's walls differently, thus producing standing waves and other forms of sound diffraction.

SUMMARY

Thereafter, the disadvantages of the adjustment in current systems of headphones can be summarized according to the functions which they perform:

(a) The telescopic detent-based adjustment is a conceptually contradictory system. The detent's holding power has to be strong enough to secure the earpiece in place, and, at the same time, it becomes a nuisance when one needs to move the earpiece in order to adjust it. The greater is the holding power of the detent—the more resistance it creates to adjust the earpiece.

(b) With the introduction of plastic as a main structural material the earpiece detent-based support becomes liable to get loose or shift from the headband, causing dislocation of the earpiece from the proper position on the pinna, thus making the adjustment unsustainable.

(c) Considering the nature of forces which are involved in the self-adjustment process and the great variety of human forms, the axial self-adjustment system inevitably creates excessive pressure on the scull and ears, and especially, if the wearer's head is bigger than the average one. Therefore this type of adjustment provides quick but eventually unsustainable and uncomfortable accommodation to the user. The accommodation is unsustainable because the system's elastic member gets loose due to its continuous usage, and it is uncomfortable because of gradually increasing impact of excessive pressure over the time of wearing.

(d) The ball-and-socket joint based on the "spherical knob at the end of a shaft" concept is rather bulky and often needs a complex supporting structure. Accordingly, it necessitates having additional room to accommodate the joint, and this significantly increases the headphone's overall size.

(e) In some embodiments the joint can be positioned in a special recessed area of the driver cup in order to reduce its size. The side effect of this design is that it compromises the acoustical quality of the cup. Sound waves bounce off the recessed area parallel walls and other cup's walls in a different way, thus generating standing waves as well as other forms of sound diffraction.

(f) After some period of usage and consequent mechanical wear, this type of joint could unexpectedly fall apart, because its design only relies on material properties and the joint is not secured in any other manner.

BRIEF SUMMARY OF THE INVENTION

Accordingly, it is an object of this invention to provide a headphone device which avoids the above-mentioned disadvantages of the prior art, and to match the needs of various wearers by its complete and comfortable adjustment to them. More specifically, it is an object of the present invention to provide a headphone device capable of quick, precise and sustainable axial adjustment in a wide range of motion without causing uncomfortable pressure on the user's scull or ears. Another object of the present invention is to create an ergonomically correct and acoustically desirable interface between the ear and the headphone.

This innovative headphone design has evolved from the observation of a conventional self-adjusting headset quite often not fitting comfortably and creating excessive pressure either on the scull or ears. These problems preclude the user from wearing it comfortably for a relatively long time in a single session. Also, the apparent diversity of human shapes, sculls, and ears in particular, is much greater than it was originally assumed as the basis for development of the conventional self-adjustable headset. This has to be taken into account by enabling earpieces to have substantial angular motion in all directions, and thus allowing to align the earpieces with any kind of user's pinna.

These problems are solved in the proposed headphone by creating two innovative systems of adjustment, headpiece vertical axial adjustment and earpiece self-adjustment, and then incorporating them into the proposed headset. Therefore, several objects and advantages of the present invention are:

(a) The headphone axial adjustment, being essentially an accommodation to the head's parameters, has a wide range of motion and provides means for the user to choose and then keep the most comfortable earpiece position in relation to the size and shape of his or her head. A sliding block-gear rack mechanism provides substantial holding power to secure the earpiece in place, and, at the same time, it allows to reduce it to a necessary minimum when the user moves the earpiece in order to adjust it.

(b) All structural elements, including detents, of the sliding block-gear rack mechanism—are inexpensive injection molded plastic. Its innovative design allows to hold a chosen position of the earpiece for any period of time without being loose or dislocated.

(c) The proposed axial adjustment mechanism does not produce vertical return forces with corresponding excessive pressure on the head that any conventional self-adjustment mechanism generates. It allows to reduce the pressure created by the headband to a minimally necessary level only for balancing the headphone weight and to hold earpieces in an acoustically proper position, thus providing precise and sustainable adjustment of the headpiece to the user.

(d) The earpieces self-adjustment is provided by the innovative hollow ball-and-socket joint design. It incorporates the spherical driver housing, driver cup, and the headband arm as main structural elements of the joint. It does not require any additional space to accommodate the joint.

(e) With the present invention the driver cup's geometry is defined by acoustical requirements as well as structural ones. The acoustically optimal spherical driver cup does not produce standing waves and other distortions of sound. Also, the range of motion is substantially greater than that of a conventional ball-and-socket joint based on the "spherical knob at the end of a shaft" design.

(f) The proposed hollow ball-and-socket joint can endure prolonged usage because its all structural elements are securely hold together by sandwiching the driver cup between the arm and the holder.

With this invention a wearer adjusts the headphone by a simple downward move of the earpieces while simultaneously depressing the release buttons with either the index or middle finger, making it easy to use. When a comfortable position of the earpieces is reached, the release buttons are set free thus allowing for locking the earpieces directly in that location. Further manipulation is unnecessary, because the earpieces are completely self-adjustable in respect to the user's ears.

The synergetic combination of the axial degree of freedom in vertical adjustment with the three rotational degrees of freedom in the ball-and-socket joint allows to create an ergonomically and acoustically necessary coupling space between the user's ear and the headphone without causing uncomfortable pressure either on the scull or the ear. It radically differs from the commonly used methods by giving the user a means to control the process of adjustment while keeping this process as quick and simple as that of a conventional self-adjustable headset. Therefore, the proposed adjustment system balances the ease of use with comfortable, precise and sustainable accommodation to the user. Further objects and advantages of the invention will become apparent from a consideration of the drawings and ensuing description.

BRIEF DESCRIPTION OF THE SEVERAL VIEWS OF THE DRAWING

Drawings Figures

The invention will be more readily understood with reference to the accompanying drawings, wherein.

REFERENCE NUMERALS IN DRAWINGS

| | |
|---|---|
| Prior Art | |
| 10 headband | 11 mating socket |
| 12 driver housing | 13 spherical knob |
| Present invention | |
| 20 headband assembly | |
| 30 headband | 31 gear rack |
| | 32 screw |
| 40 headstrap | |
| 50 arm | 51 pin |
| | 52 screw |
| 60 sliding block | 61 front housing |
| | 62 rear housing |
| | 63 flat spring |
| | 64 release button |
| | 65 spacer |
| | 66 detent |
| | 67 screw |
| 70 earpiece | 71 driver cup |
| | 72 elliptical opening |
| | 73 holder |
| 80 driver unit | 81 driver plate |

DETAILED DESCRIPTION OF THE INVENTION

Figure 1:
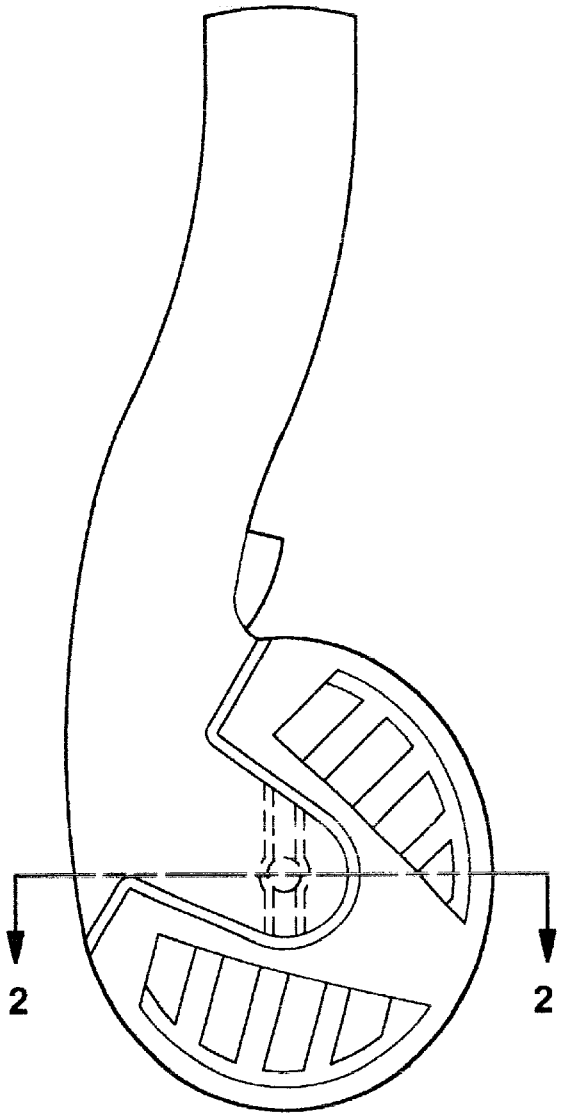
FIG. 1 PRIOR ART
FIG. 1 is a side view of a headphone equipped with a conventional ball-and-socket joint.
Figure 2A:
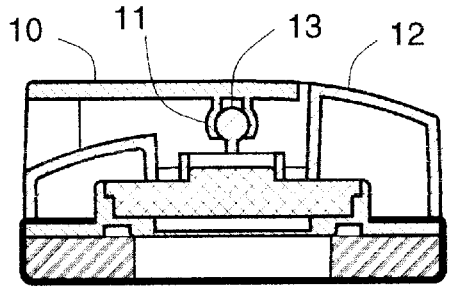
FIG. 2A is a sectional view taken along section line 2—2 of FIG. 1 when a driver unit is in a neutral position in relation to a headband.
Figure 2B:
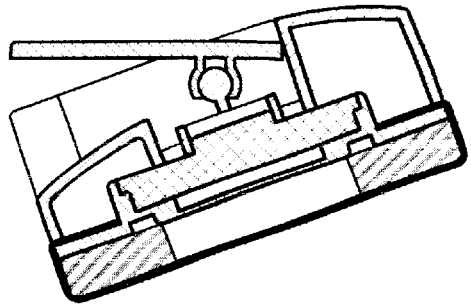
FIG. 2B is a sectional view taken along section line 2—2 of FIG. 1 when the driver unit is moved to an extreme position in relation to the headband.
Figure 3:
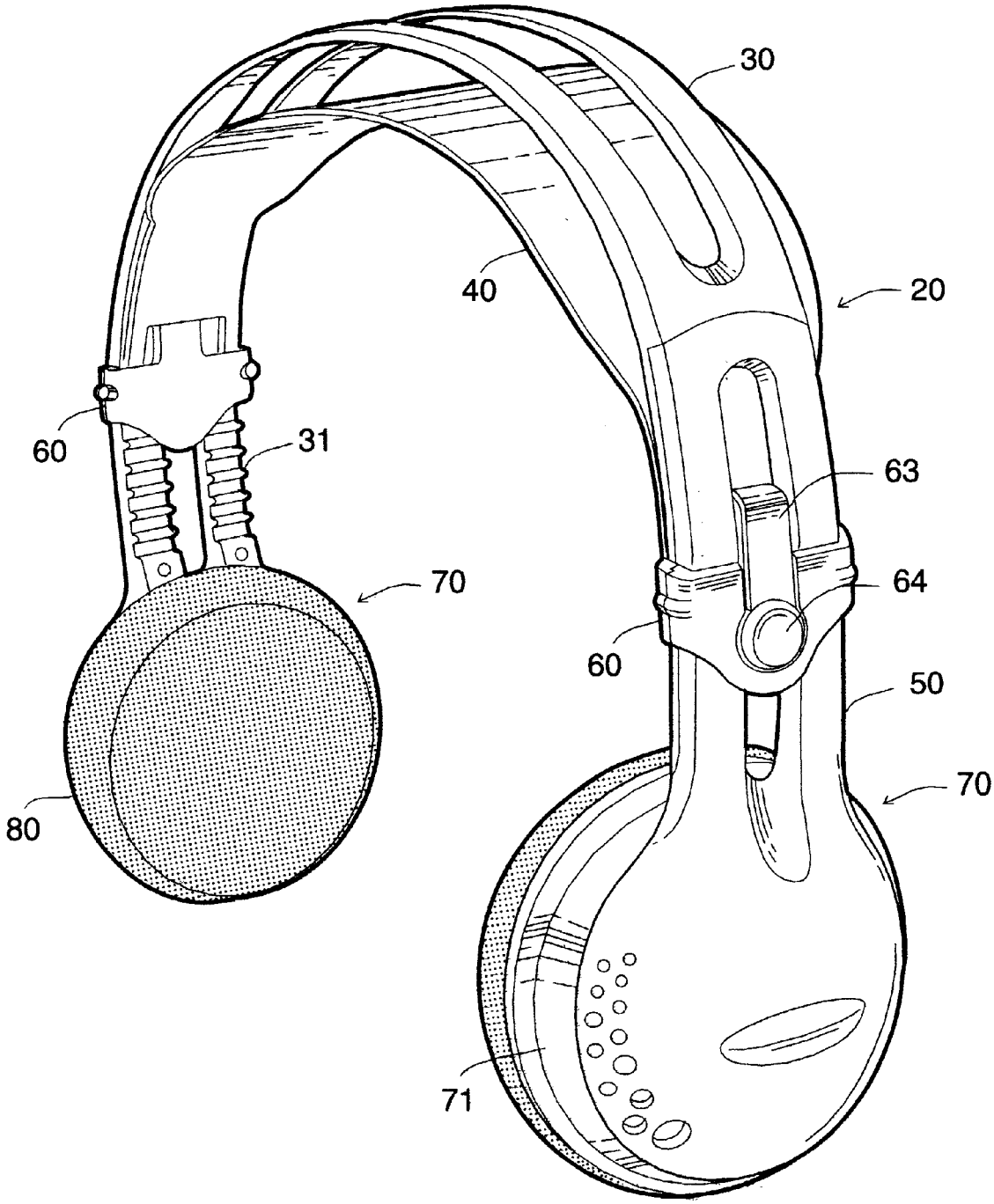
FIG. 3 is an overall perspective view of a headphone device according to an embodiment of the present invention.
Figure 4:
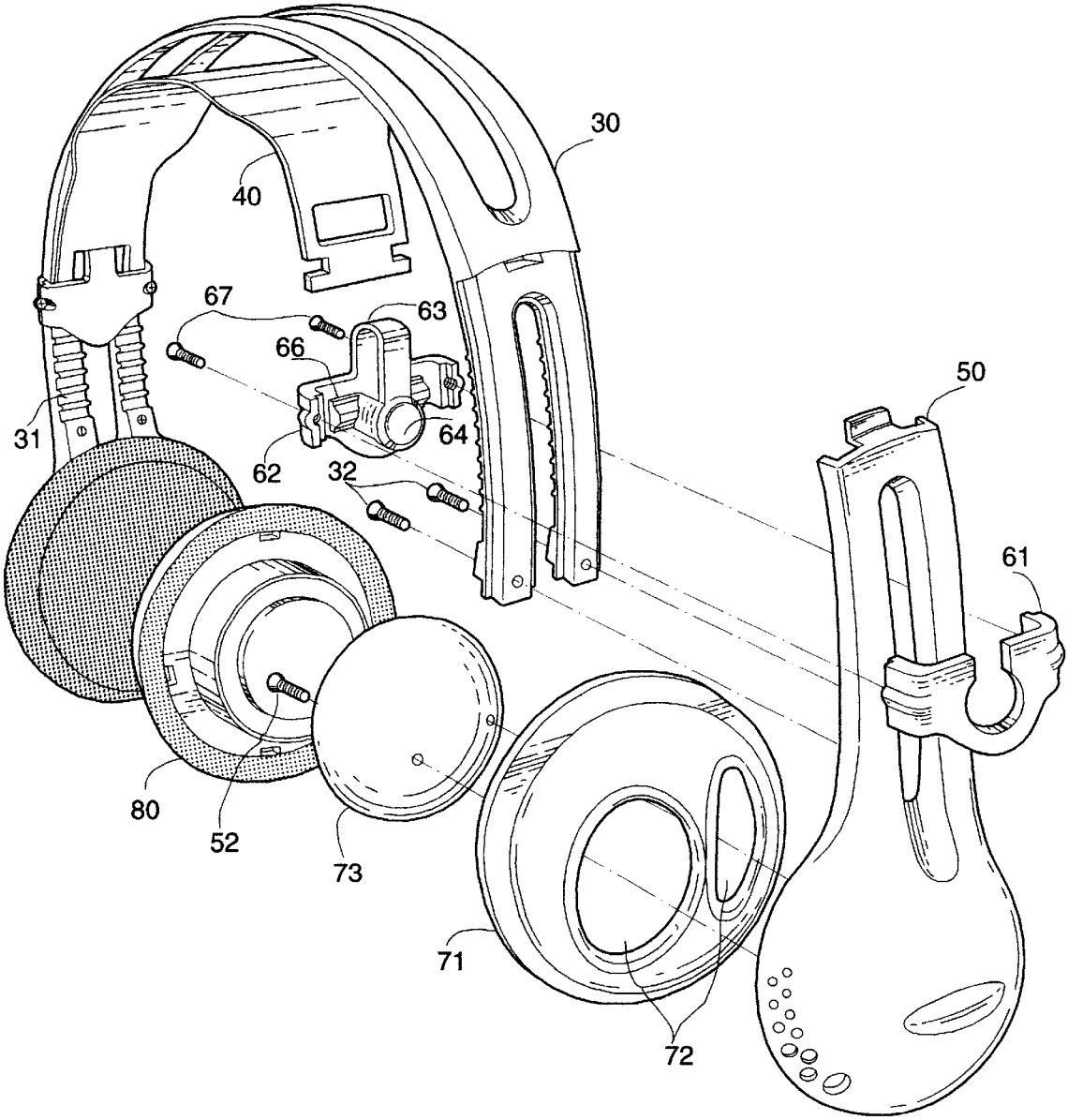
FIG. 4 is an exploded perspective view of a headphone device of FIG. 3.
Figure 5:
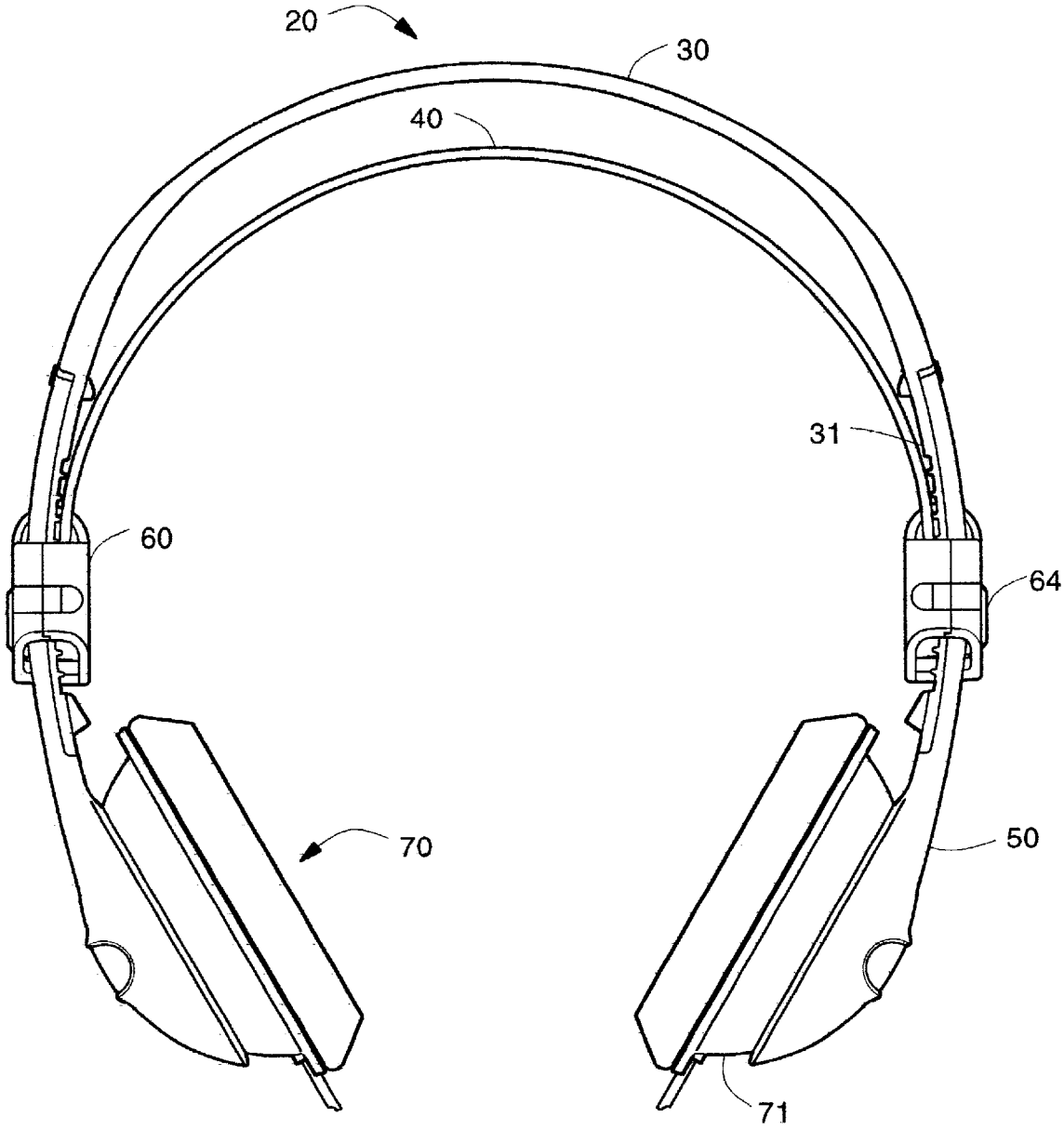
FIG. 5 is a front view of a headphone device of FIG. 3.
Figure 6:
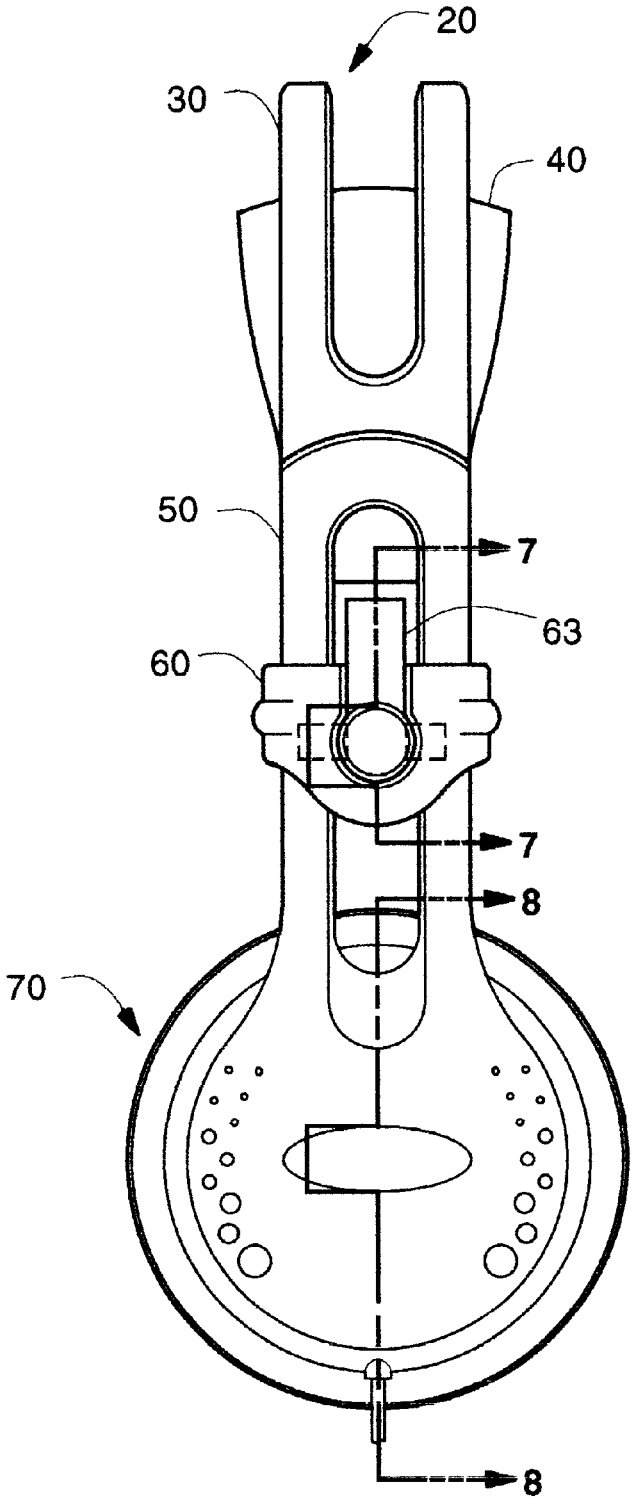
FIG. 6 is a side view of a headphone device of FIG. 3.

A preferred embodiment of the adjustable headphone of the present invention is illustrated in FIG. 3 (overall perspective view), FIG. 4 (exploded perspective view), FIG. 5 (front view), and FIG. 6 (side view). This adjustable headphone comprises a pair of self-adjusting earpieces 70 which are interconnected by a headpiece which includes a stiff resilient headband assembly 20 and a soft flexible headstrap 40 which rests against the wearer's head.

The headband assembly 20 includes a headband 30 itself and two holding members, the arms 50 which are connected to each earpiece 70 by means of a hollow ball-and-socket joint. The headstrap 40 is anchored at both ends to the corresponding sliding block 60 which is movably joined to the headband assembly 20. This connection allows either the sliding block 60 to move along the assembly 20, or reversely, this assembly 20 to be pulled through the sliding block 60 when it is respectively positioned. The assembly 20 includes the headband's fork-like end structure with a set of teeth on its inner surface which functions as a gear rack 31. The assembly 20 is held together with two screws 32.

The sliding block 60 itself consists of two parts—front housing 61 and rear housing 62. The sliding block's functional features are provided by the rear housing 62 design. The main part of the rear housing is a flat spring 63 connected to a pair of the symmetrically positioned detents 66 by two spacers 65. Molding requirements for the spring 63 necessitate having the two detents 66 apart. A lower part of the spring 63 becomes a release button 64. All these elements are integrally molded as part of the sliding block 60. The front housing has an opening to accommodate the front part of the spring 63 with the release button 64. Both housings are held together by two screws 67.

Figure 7A:
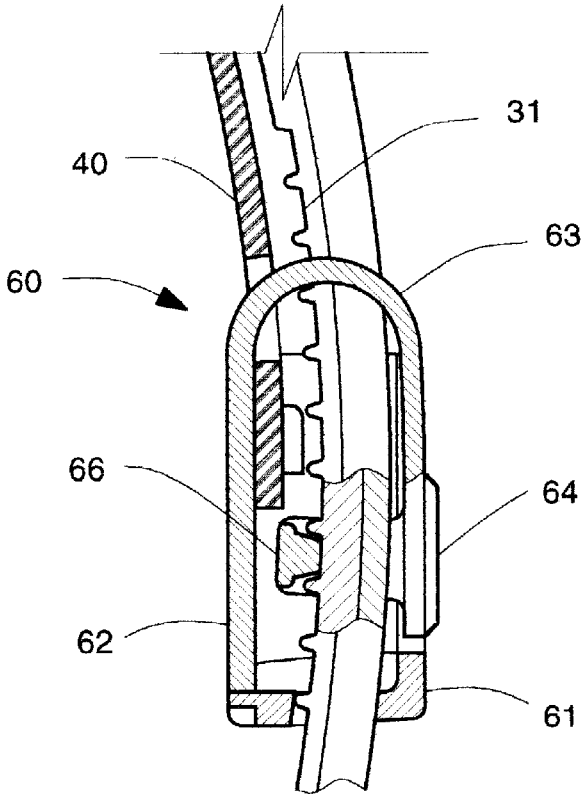
FIG. 7A is a sectional view taken along section line 7—7 of FIG. 6 when a detent is engaged with a headbands gear rack.
Figure 7B:
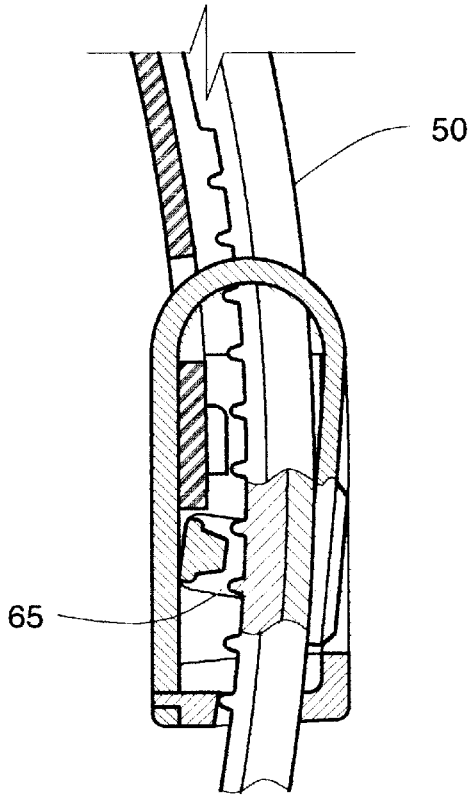
FIG. 7B is a sectional view taken along section line 7—7 of FIG. 6 when the detent is disengaged with the headband's gear rack.

Both the sliding block 60 and gear rack 31, while working in collaboration, create a vertical axial adjustment mechanism. It has two main working positions—engaged and disengaged. The engaged position is shown in FIG. 7A and, correspondingly, the disengaged position is shown in FIG. 7B. Normally, a detent 66 with release button 64, rest between the rack's two teeth holding the headband in an engaged position. Loading the spring 63 is employed to cause the detent 66 to maintain constant contact between it and the gear rack 31. By depressing the release button 64 the user disengages the detent 66, and either the sliding block 60 can freely move along the rack 31 or the headband assembly 20 can be pulled through the sliding block 60. By removing pressure from the release button 64 the wearer instantly stops either the sliding block 60 or the assembly 20 in a position, apparently, most desirable for the person.

Figure 8A:
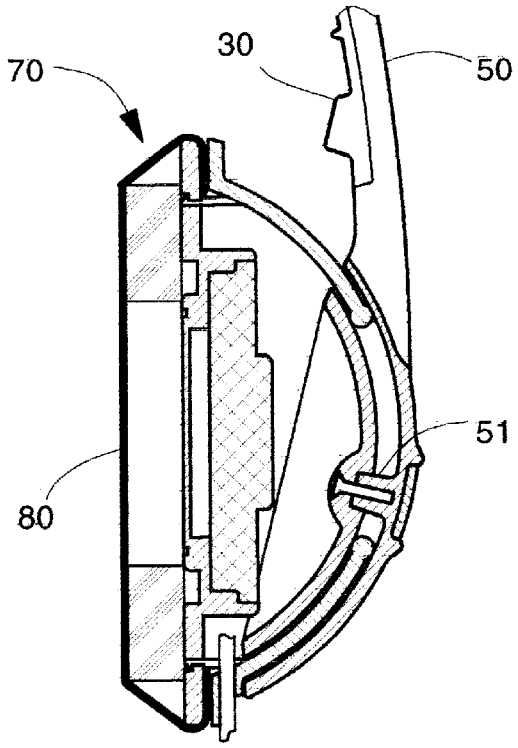
FIG. 8A is a sectional view taken along section line 8—8 of FIG. 6, when a driver unit is in a neutral position in relation to a headband assembly.
Figure 8B:
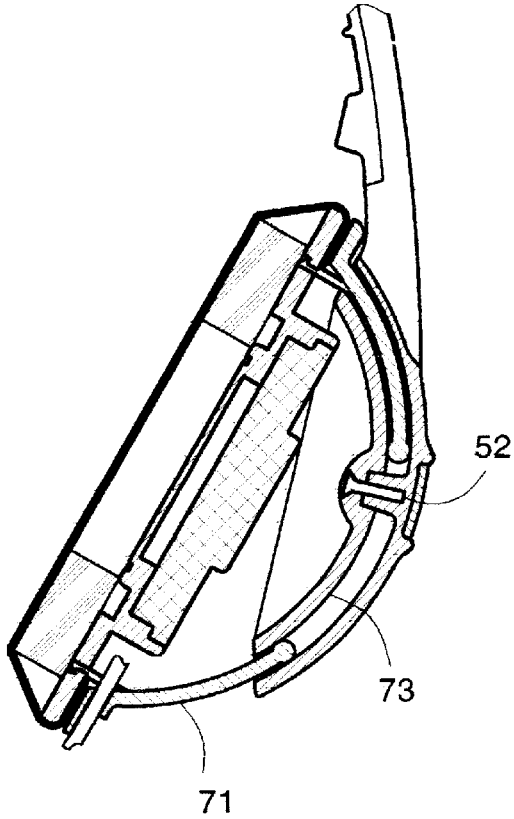
FIG. 8B is a sectional view taken along section line 8—8 of FIG. 6, when the driver unit is moved to an extreme position in relation to the headband assembly.

As shown in FIG. 8A and FIG. 8B the bottom part of the headband's arm forms a semi-spherical element designed to hold the earpiece 70. The earpiece 70 consists of a driver unit 80 and a semi-spherical driver cup 71□which is snapped to the driver plate element 81 of the driver unit 80. The earpiece 70 and the arm 50 form a hollow ball-and-socket joint where the spherical driver cup 71 works as a ball part of the joint, and it mates with the arm's 50 inner spherical surface, which is a socket part of the joint.

The arm has two pins 51 located on its inner concave surface, and respectively, the driver cup 71 has two symmetrically placed, vertically oriented elliptical openings 72. The pins 31 penetrate these openings 61 thus allowing for the joint assembly. The joint is held together by sandwiching the driver cup 71 between the arm 50 and a corresponding holder 73. This assembly is secured with two screws 52. The size and shape of the elliptical openings 72, shown in FIG. 4, define and limit the movement of the driver cup 71, and respectively, the earpiece 70 to provide the self-adjusting earpiece with a substantial angular motion in all directions. Also this double-opening design prevents the driver unit 80 from undesirable rotation.

OPERATION

The operating state of the adjustable headphone of the present invention will now be explained. Before the headphone is fitted onto the head, the sliding block 60 and, respectively, the headstrap 40 are in the lowest, closest to the earpiece 70, position on the gear rack. In this position the distance between the earpiece 70 and the apex of the headstrap 40 is minimal, thus corresponding to the smallest head size. Then the wearer dons the headphone by holding the earpieces 70 in his or her hands, and then adjusts the headphone by simply sliding the earpieces 70 down, while simultaneously depressing the release buttons 64. When a comfortable position for the earpieces 70 facing the pinnas is reached, the release buttons 64 are set free thus allowing for locking the headband assembly 20 and respectively the earpieces 70 directly in that location. Simultaneously the headstrap 40 conforms to the shape of the wearer's head, contributing to a secure fit.

Further manipulation is unnecessary, because the earpieces 70 are completely self-adjustable in respect to the user's ears, hence allowing to create the ergonomically and acoustically necessary interface between the driver unit 80 and the wearer's pinna. Needless to say, various modified constructions, other than the construction disclosed in the preferred embodiment described above, can be employed.

CONCLUSION, RAMIFICATIONS, AND SCOPE

Accordingly, the reader will see that the adjustable headphone of this invention can be comfortably worn by any user for prolonged listening to any particular audio source, program or audio file. It is achieved by allowing the earpieces to be fully adjusted to have a comfortable and close fit to the user's ear in a virtually pressureless manner. The earpieces full adjustment consists of the vertical axial adjustment for optimizing the distance from the top of the user's head to the user's ear, and the earpiece self-adjustment for optimizing the interface between the driver and the user's outer part or the ear, the pinna.

The headpiece vertical axial adjustment mechanism has a wide range of motion accommodating a variety of shapes of human heads, and provides a quick and precise positioning of the drivers to face the user's pinnas. This adjustment can be maintained for any chosen period of time. The headpiece vertical axial adjustment mechanism performs its function without having noticeable return forces and thus the friction between the earpiece pad and the user's ear, and respectively the pressure created by the headband, are minimal enough to hold the headphone in place. Hence, the pressure on the user's scull or ears, resulting from wearing the headphone, is rather insignificant, because the forces affecting the head are small and balanced.

The earpiece self-adjustment is provided by the proposed hollow ball-and-socket joint connecting the headband arm and the earpiece. This joint is able to provide the self-adjusting earpiece with substantial angular motion in all directions effortlessly. It enables the driver to align to any particular ear shape and provide close and comfortable fit to the pinna. The earpiece's close fit allows to form an acoustically desirable coupling space between the driver and the auditory canal of the ear.

This ball-and-socket joint incorporates the spherical driver housing, driver cup, and headband arm as its main structural elements. It does not require any additional space to accommodate the joint, thus keeping the geometry of the driver cup acoustically efficient. The driver cup's spherical shape helps to avoid standing waves and other sound distortion. Also, the range of motion is substantially greater than that of a conventional ball-and-socket joint based on the "spherical knob at the end of a shaft" design. Additionally, this joint can endure prolonged usage, because of the driver cup's secure placement between the arm and the holder, which makes the joint very durable.

Furthermore, the proposed headphone is inexpensive, all its housings and structural parts are injection molded plastic. The number of parts is minimal and their assembling process is quick and simple. For instance, such a functionally important and structurally complex unit as the sliding block consists of only two easily assembled parts.

Although the description above contains many specificities, these should not be construed as limiting the scope of the invention but as merely providing illustrations of the presently preferred embodiment of this invention. For example, the proposed hollow ball-and-socket joint can be employed to connect a telephone handset and its speaker. The axial adjustment mechanism can be used in combination with any type of earpieces as well as the hollow ball-and-socket joint can be used to connect an earpiece with any kind of headbands or neckbands. Thus the scope of this invention should be determined by the appended claim and its legal equivalents, rather than by the examples given.

What we claim as our invention is:

1. A headphone comprising:

(a) a stiff resilient headband assembly having at least one plurality of depressions on its inner surface organized in a gear rack manner;

(b) a flexible headstrap movably joined with said headband assembly;

(c) a sliding block anchoring said headstrap and able to move upward and downward along the gear rack, wherein having at least one spring-loaded detent coming in contact with said gear rack, and having means for manual disengagement of the detent with said gear rack, thus allowing to control mutual positioning of said sliding block and said headband assembly;

(d) a self-adjusting earpiece mounted on at least one of the two arms of said headband assembly;

(e) a hollow ball-and-socket joint where the spherical driver cup works as a ball part of the joint, and it mates to the arm's inner spherical surface, which forms a socket part of the joint, so as to be able to provide said self-adjusting earpiece substantial angular motion in all directions;

(f) whereby said earpiece will be fully adjusted to have a comfortable and close fit to the user's pinna in a virtually pressureless manner, and this adjustment can be maintained for any chosen period of time.

* * * * *